US009238179B2

(12) United States Patent
Carpenter

(10) Patent No.: US 9,238,179 B2
(45) Date of Patent: Jan. 19, 2016

(54) BUILDING BLOCK TOY WITH INTERCONNECTING EDGES

(76) Inventor: Elizabeth Sharon Carpenter, New York, NY (US)

( * ) Notice: Subject to any disclaimer, the term of this patent is extended or adjusted under 35 U.S.C. 154(b) by 0 days.

(21) Appl. No.: 13/283,419

(22) Filed: Oct. 27, 2011

(65) Prior Publication Data

US 2012/0274023 A1 Nov. 1, 2012

Related U.S. Application Data

(60) Provisional application No. 61/455,950, filed on Oct. 30, 2010.

(51) Int. Cl.
*A63H 33/08* (2006.01)
*A63H 33/06* (2006.01)

(52) U.S. Cl.
CPC ..... *A63H 33/062* (2013.01); *A63H 33/065* (2013.01); *A63H 33/082* (2013.01); *Y10T 29/49826* (2015.01)

(58) Field of Classification Search
CPC . A63H 33/062; A63H 33/082; A63H 33/065; A63H 33/108; A63H 33/088; A63H 33/04; A63H 33/08; A63F 9/1204
USPC ..... 273/146, 276, 288; 446/101, 117, 118, 446/119, 120, 121, 122, 123, 124, 125, 126
See application file for complete search history.

(56) References Cited

U.S. PATENT DOCUMENTS

| | | | | | |
|---|---|---|---|---|---|
| 319,764 | A * | 6/1885 | Westcott | 446/125 |
| 2,565,823 | A * | 8/1951 | Pool | 446/127 |
| 2,649,803 | A * | 8/1953 | Andre | 446/104 |
| 3,566,531 | A * | 3/1971 | Hasel | 446/120 |
| 3,670,449 | A * | 6/1972 | Lemkin et al. | 446/102 |
| 3,717,948 | A * | 2/1973 | Schnabel | 446/128 |
| 3,728,800 | A * | 4/1973 | Magram | 434/171 |
| 4,026,065 | A * | 5/1977 | Dick | 446/121 |
| 4,302,900 | A * | 12/1981 | Rayner | 446/120 |
| 4,758,195 | A * | 7/1988 | Walsh | 446/85 |
| 5,000,713 | A * | 3/1991 | Cheng | 446/120 |
| 5,013,245 | A * | 5/1991 | Benedict | 434/170 |
| 5,554,062 | A * | 9/1996 | Goldsen | 446/124 |
| 5,645,464 | A * | 7/1997 | Chen | 446/120 |
| 5,924,906 | A * | 7/1999 | Grafton | 446/121 |
| 6,186,856 | B1 * | 2/2001 | Chen | 446/128 |
| 6,599,128 | B2 * | 7/2003 | Roberts | 434/128 |
| 6,679,780 | B1 * | 1/2004 | Shih | 273/157 R |
| 7,198,270 | B1 * | 4/2007 | Bishop | 273/156 |
| 2005/0189715 | A1 * | 9/2005 | Shideler et al. | 273/255 |

* cited by examiner

*Primary Examiner* — Vishu Mendiratta
(74) *Attorney, Agent, or Firm* — DLA Piper LLP (US)

(57) ABSTRACT

The present invention relates generally to a block toy and a method for producing the same, and in particular to a block with interconnecting edges that can have other blocks connected thereto in succession in three dimensions to form various shapes and a method for producing the same.

11 Claims, 5 Drawing Sheets

BUILDING BLOCK TOY WITH INTERCONNECTING EDGES

CROSS REFERENCE TO RELATED APPLICATION(S)

This application claims the benefit of priority under 35 U.S.C. §119(e) of U.S. Ser. No. 61/455,950, filed Oct. 30, 2010, the entire content of which is incorporated herein by reference.

BACKGROUND OF THE INVENTION

1. Field of the Invention

The present invention relates generally to a block toy and a method for producing the same, and in particular to a block with interconnecting edges that can have other blocks connected thereto in succession in three dimensions to form various shapes and a method for producing the same.

2. Background Information

Toy building block sets are generally known. Toy building block sets are often an important part of a child's learning and development process. Conventional building block sets allow children to use their imagination and/or creativity to build and/or create a generally limitless number of configurations and/or structures. Toy building blocks are an article of manufacture that serves an important purpose helping children to learn to think spatially and creatively and to develop coordination and motor skills.

Traditional play with toy building blocks require the toy building blocks to be placed next to and on top of other building blocks (in other words, piling on) in order to build structures. It is difficult to build anything but simple equally balanced structures because if the blocks are not aligned with equal or lesser weight distribution from the base upwards, the structure will fall down due to the force of gravity.

In the past, toy block inventors have overcome this problem by having small tabs or protrusions that snap into indentations on the opposite side of the blocks (such as in the case of "Legos") or by adding connector pieces to hold the building structure together.

The present invention has a unique way to interconnect. The invention is an improvement on the classic building block because it is shaped to allow for interconnectivity of multiple blocks in a simple but practical manner. To play with my Building Block Toy With Interconnecting Edges, the building blocks can be interconnected by sliding two blocks together or can be played with in the traditional "piling-on" fashion. The present invention is distinguished from other building block inventions because of the way two of my blocks interconnect.

SUMMARY OF THE INVENTION

The present invention relates generally to a block toy and a method for producing the same, and in particular to a block with interconnecting edges that can have other blocks connected thereto in succession in three dimensions to form various shapes and a method for producing the same.

Accordingly, in one embodiment, the present invention provides a toy block comprising a center piece (21), an extension piece (24) and a spacer piece (26). The extension piece (24) is attached to the spacer piece (26), which is attached to the center piece (21).

In another embodiment, the present invention provides a block comprising a center piece (21) with at least two insertion holes (22), an extension piece (24), a spacer piece (26) and at least two cylindrical protruding rods (27). The extension piece (24) is attached to the spacer piece (26), which is attached to the protruding rods (27). The protruding cylindrical rods (27) are inserted into the insertion holes (22) in the center piece (21) thereby attaching the extension piece to the center piece (21).

In one aspect, the center piece (21), extension piece (24) and the spacer piece (26) are solid. In another aspect the protruding cylindrical rods (27) are solid. In further aspect, the center piece (21), extension piece (24) and spacer piece (26) are hollow. In another aspect the protruding cylindrical rods (27) are hollow.

In another embodiment, the toy block is comprised of a center piece (21) which is square, and extension piece (24) and spacer piece (26) which are rectangular. Optionally, the block further comprises protruding cylindrical rods (27) and insertion holes (22).

Accordingly, in one aspect, the extension piece (24) and spacer piece (26) are squarely attached to the center piece (21). In another aspect, the extension piece (24) and spacer piece (26) are not squarely attached to the center piece (21).

In a further embodiment, the center piece (21), extension piece (24), spacer piece (26) and protruding cylindrical rods (27) are made of acrylic, wood, plastic, rubber, metal, bamboo or other suitable materials.

In a further embodiment, the face of the extension piece (24) has the same shape and dimension as the face of the center piece (21). In a further aspect, the spacer piece (26) has at least the same thickness or larger than the extension piece (24). In yet another aspect, the face of the spacer piece (26) is half the size of the face of the extension piece (24). In another aspect, the protruding cylindrical rods (27) are at most half of the depth of the center piece (21) in length. In a further aspect the protruding cylindrical rods (27) are thicker at the end which is inserted into the center piece (21) and taper at the end that connects to the spacer piece (26). In one aspect, the insertion holes (22) are the same size or slightly smaller than the thicker end of the protruding cylindrical rods (27).

In another embodiment, the extension piece (24) and spacer piece (26) are manufactured as one piece. In further aspect, the extension piece (24), spacer piece (26) and protruding cylindrical rods (27) are manufactured as one piece.

In a further embodiment, two or more blocks interconnect whereby the extension piece (24) of a first block slides between the extension piece (24) and center piece (21) of a second block. In one aspect, an infinite number of blocks can interconnect.

In another embodiment, the blocks may interconnect to form a model. In a further aspect, a kit comprises blocks that interconnect to form a model.

In yet another embodiment, the blocks are a game. In one aspect the game comprises, toy blocks and optionally a game board, game tokens, dice, a spinner, and/or cards.

A further embodiment includes a method of manufacturing a block toy.

DETAILED DESCRIPTION OF THE INVENTION

Figure 1:
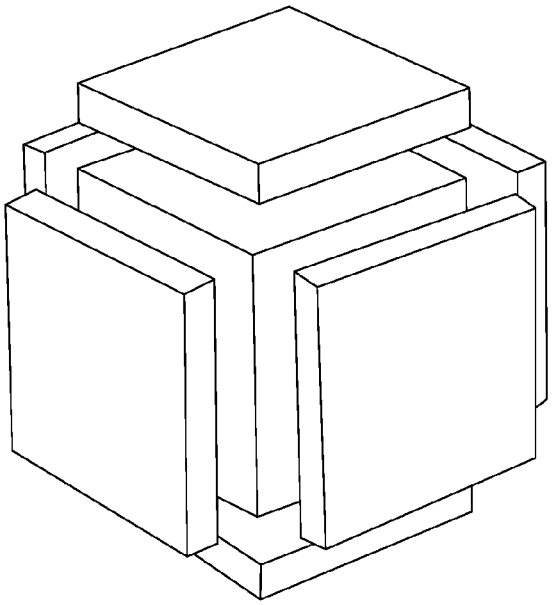
FIG. 1 shows a prototype of a single block.
Figure 2:
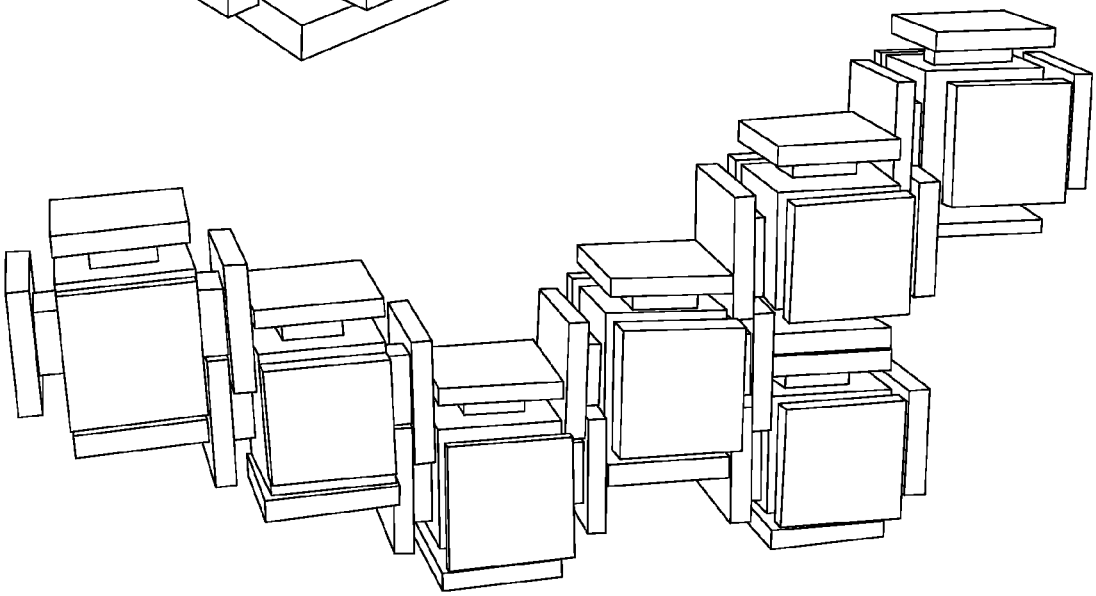
FIG. 2 shows prototypes of seven blocks that have been interconnected.
Figure 3:
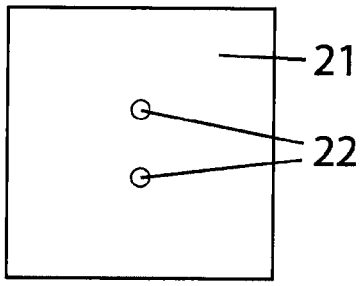
FIG. 3 shows a side view of the center piece (21). The face of the center piece (21) has insertion hole(s) (22).
Figure 5:
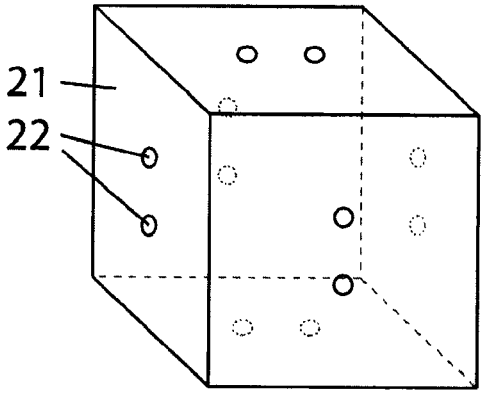
FIG. 5 shows a perspective view of the center piece (21). As shown, each face of the center piece (21) has insertion hole(s) (22).
Figure 4:
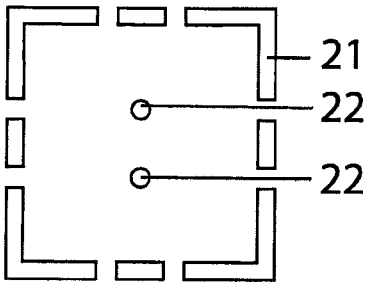
FIG. 4 shows a crosscut view of the center piece (21). The face of the center piece (21) has insertion hole(s) (22).

The present invention relates generally to a block toy and a method for producing the same, and in particular to a block with interconnecting edges that can have other blocks connected thereto in succession in three dimensions to form various shapes and a method for producing the same.

Before the present compositions and methods are described, it is to be understood that this invention is not limited to particular compositions, methods, and experimental conditions described, as such compositions, methods, and conditions may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "the method" includes one or more methods, and/or steps of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Although any methods and materials similar or equivalent to those described herein can be used in the practice or testing of the invention, the preferred methods and materials are now described.

Accordingly, in one embodiment, the present invention provides a toy block comprising a center piece (21), an extension piece (24) and a spacer piece (26). The extension piece (24) is attached to the spacer piece (26) that is attached to the center piece (21) to form a block with edges which can interconnect.

In another embodiment, the present invention provides a block comprising a center piece (21) with at least two insertion holes (22), an extension piece (24), a spacer piece (26) and at least two cylindrical protruding rods (27). The extension piece (24) is attached to the spacer piece (26) which is attached to the protruding rods (27). The protruding cylindrical rods (27) are inserted into the insertion holes (22) in the center piece (21) thereby attaching the extension plate to the center piece (21) to form a block with edges which can interconnect.

In one aspect, the center piece (21), extension piece (24) and the spacer piece (26) are solid. In another aspect the protruding cylindrical rods (27) are solid. In further aspect, the center piece (21), extension piece (24) and spacer piece (26) are hollow. In another aspect the protruding cylindrical rods (27) are hollow. In, another aspect, the present invention may comprise a solid center piece (21), extension piece (24), spacer piece (26) and optionally protruding cylindrical rods (27). In yet another aspect, the present invention may comprise a hollow center piece (21), extension piece (24), spacer piece (26) and optionally protruding cylindrical rods (27). In another aspect, the present invention may comprise any combination of solid or hollow center piece (21), extension piece (24), spacer piece (26) and optionally protruding cylindrical rods (27). In one aspect, if the blocks comprise protruding cylindrical rods (27) then the center piece (21) comprises insertion holes (22). In a further aspect, if the toy block comprises protruding cylindrical rods (27) and insertion holes (22) there will be an equal number of both. In another aspect, there can be 1-10 protruding cylindrical rods (27) and insertion holes (22). In a preferred aspect, the toy block comprises two protruding cylindrical rods (27) and two insertion holes (22).

In one aspect the toy blocks of the present invention can be of any color, texture or pattern. In another aspect, the extension pieces may be interchangeable.

In another embodiment, the block toy may be any shape as long as the center piece (21) and the extension piece (24) faces are the same shape and size. Nonlimiting examples of potential shapes include cuboid or rectangular prisms, tetrahedron pyramids or another polyhedrons. In a preferred embodiment, the toy block is comprised of a center piece (21) which is a cube, and extension piece(s) (24) and spacer piece(s) (26) which are rectangular prisms. In one aspect, the block further comprises protruding cylindrical rods (27) and insertion holes (22).

Accordingly, in one aspect, the extension piece (24) and spacer piece (26) are squarely attached to the center piece. In another aspect, the extension piece (24) and spacer piece (26) are not squarely attached to the center piece. In one aspect the extension piece (24) is offset from the center piece (21) by 1-90 degrees. In a preferred aspect, the extension piece (24) is 45 degrees offset from the center piece.

In a further embodiment, the center piece (21), extension piece (24), spacer piece (26) and protruding cylindrical rods (27) are made of acrylic, wood, plastic, rubber, metal, bamboo or other suitable materials. In a preferred embodiment, the center piece (21), extension piece (24), spacer piece (26)

and protruding cylindrical rods (27) are made of molded plastic. In another preferred embodiment, the center piece (21), extension piece (24), spacer piece (26) and protruding cylindrical rods (27) are made of molded acrylic.

In a further embodiment, the face of the extension piece (24) has the same shape and dimension as the center piece (21). In a further aspect, the spacer piece (26) has the same thickness as the extension piece (24). In yet another aspect, the face of the spacer piece (26) is half the size of the face of the extension piece (24). In another aspect, the protruding cylindrical rods (27) are at most half of the depth of the center piece (21) in length. In a further aspect the protruding cylindrical rods (27) are thicker at the end which is inserted into the center piece (21) and taper at the end which attaches to the spacer piece (26). This results in locking the extension pieces (24) in place. In one aspect, the insertion holes (22) are the same size or slightly smaller than the thicker end of the protruding cylindrical rods (27).

In one aspect the center piece (21) is a cube measuring 0.5 inches to 3 inches. In another aspect, the face of the extension piece (24) is a square measuring 0.5 inches to 3 inches and has a depth of 0.09 inches to 0.56 inches. In a further aspect, the spacer piece (26) has a square face measuring 0.25 inches to 1.5 inches and a depth of at least 0.09 inches to 0.56 inches. In another aspect the protruding cylindrical rods are 0.25 inches to 1.5 inches. In a preferred embodiment, the center piece (21) is a 1 inch square cube. In another preferred embodiment, the face of the extension piece (24) is a 1 inch square and has a depth of 0.18 inches. In a further embodiment, the face of the spacer piece (26) is a 0.5 inches square with a depth of 0.18 inches. In another preferred embodiment, the protruding cylindrical rods are 0.25 inches in length.

In another embodiment, the extension piece (24) and spacer piece (26) are manufactured as one piece. In further aspect, the extension piece (24), spacer piece (26) and protruding cylindrical rods (27) are manufactured as one piece.

In a further embodiment, two or more blocks interconnect whereby the extension piece (24) of a first block slides between the extension piece (24) and center piece (21) of a second block. In one aspect, an infinite number of blocks can interconnect.

In another aspect, the blocks may interconnect to form a model. In a further aspect, a kit comprises blocks that interconnect to form a model. As an example model contains toy blocks to make a structure or building, such as a house, sky scraper, or monument; a vehicle, such as a car, motorcycle, bus, plane, ship, helicopter or train; famous pieces of architecture such as the statute of Liberty, the Washington Monument, the Taj Mahal; urban, suburban or rural scenes; among many others.

In yet another embodiment, the blocks are a game. In one aspect the game comprises toy blocks and optionally a game board, game tokens, dice, a spinner, and/or cards.

A further embodiment includes a method of manufacturing a block toy.

Figure 8:
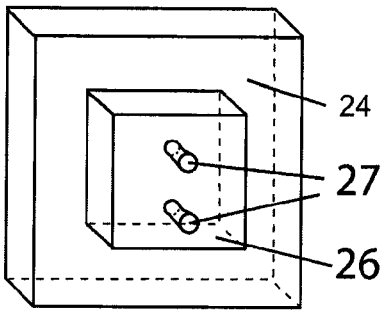
FIG. 8 shows a perspective view of an extension piece (24). Either attached to/or part of the interior face of the extension piece (24) is a spacer piece (26) and protruding cylindrical rods (27).
Figure 6:
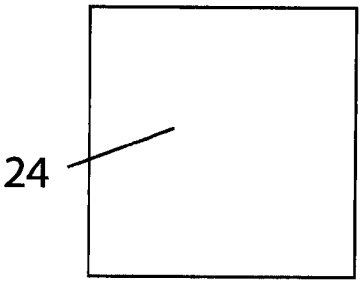
FIG. 6 shows an exterior view of an extension piece (24).
Figure 7:
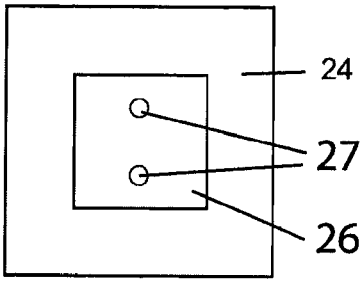
FIG. 7 shows an interior view of an extension piece (24). A spacer piece (26) is attached/or part of the interior face of the extension piece (24). Protruding cylindrical rod(s) (27) are attached to/or part of the spacer piece (26).
Figure 9:
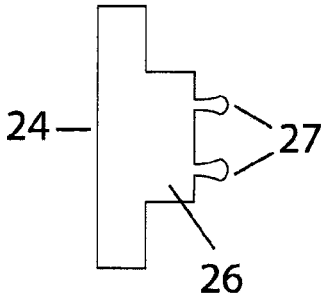
FIG. 9 shows a cross cut view of an extension piece (24). Either attached to/or a part of the interior face of the extension piece (24) is a spacer piece (26) and protruding cylindrical rods (27).
Figure 10:
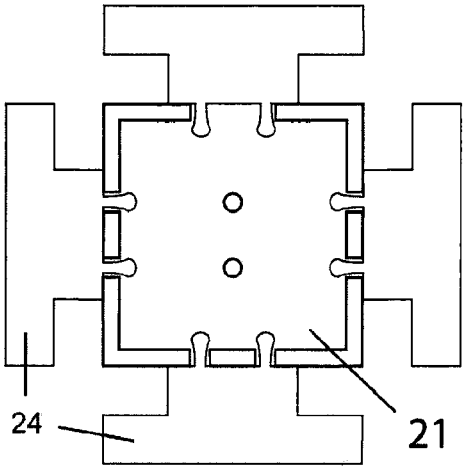
FIG. 10 shows a cross cut view of the assembled block. As shown, an extension piece (24) with a spacer piece (26) and protruding cylindrical rods (27) is inserted into the insertion holes (22) of the center piece (21).
Figure 11:
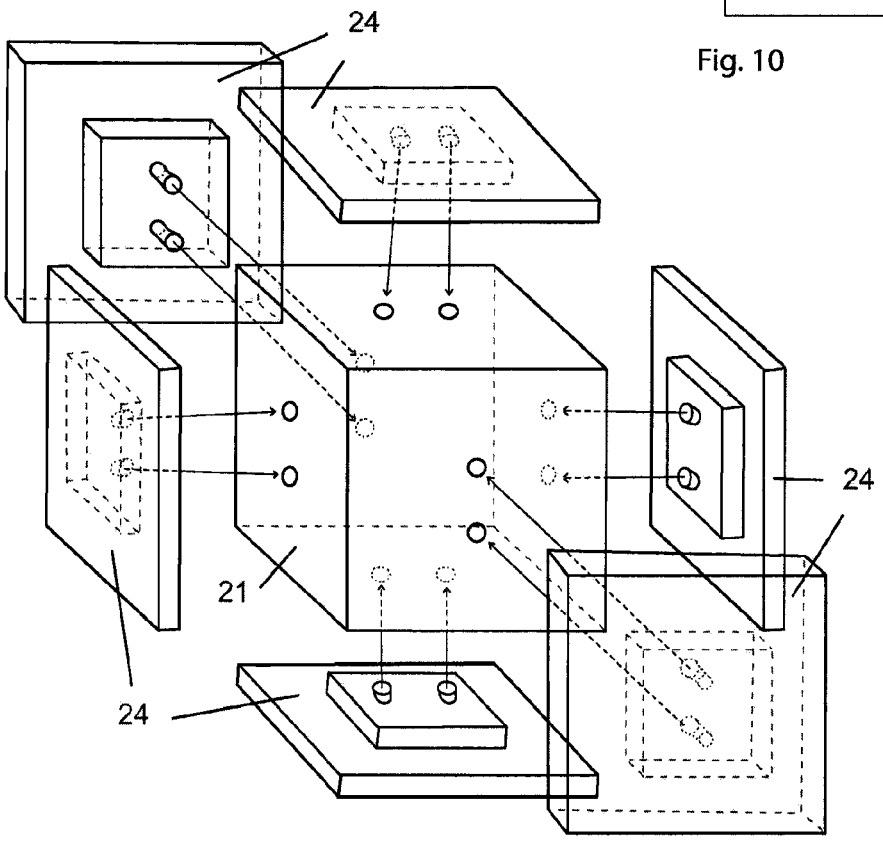
FIG. 11 shows an exploded view of the assembled block. As shown, extension pieces (24) with a spacer piece (26) and protruding cylindrical rods (27) is inserted into the insertion holes (22) of the center piece (21) on six faces.
Figure 12:
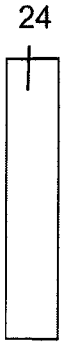
FIG. 12 shows a side view of an extension piece (24).
Figure 13:
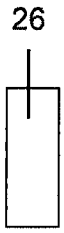
FIG. 13 shows a side view of an extension spacer (26).

In a nonlimiting example to manufacture the present invention, the toy blocks can be made with a hollow center piece (21) and protruding cylindrical rods (27) as follows: To assemble the Building Block Toy With Interconnecting Edges in plastic, the two protruding cylindrical rods (27) on the interior side of the extension piece (24) with protruding cylindrical rods (27), FIGS. 7, 8, 9, are aligned with the two insertion holes (22) on one side of the center piece (21) with holes. The two protruding cylindrical rods (27) are then inserted into the two insertion holes (22) until the parallel side of the spacer piece (26) of the extension piece (24) is in contact with the parallel side of the center piece (21) as in FIG. 10. The insertion holes (22) and the protruding cylindrical rods (27) are aligned so that the extension piece (24) and the center piece (21) will square up. Because the protruding cylindrical rods (27) are narrower at the point where the rods (27) are attached to the spacer piece (26) of the extension piece (24), and are slightly wider at the exterior end, the extension piece (24) will lock into place. This procedure is then repeated for the remaining five sides of the center piece (21) as in FIGS. 10 and 11.

Figure 14:
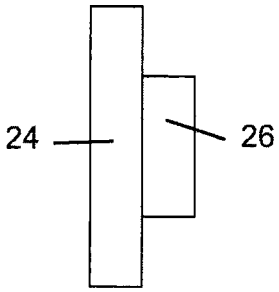
FIG. 14 shows a cross cut view of an extension piece (24) with a spacer piece (26).
Figure 15:
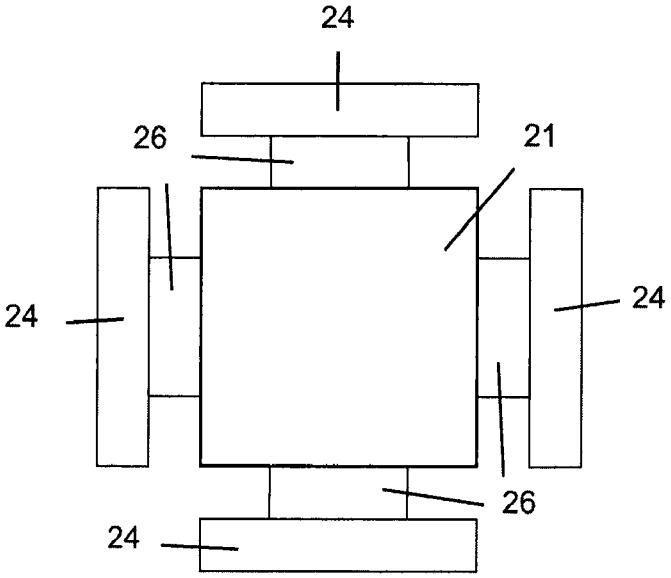
FIG. 15 shows a cross cut view of an assembled block without insertion holes (22) or protruding cylindrical rods (27). As shown the extension piece (24) is attached to the spacer piece (26) which is attached to the center piece (21).
Figure 16:
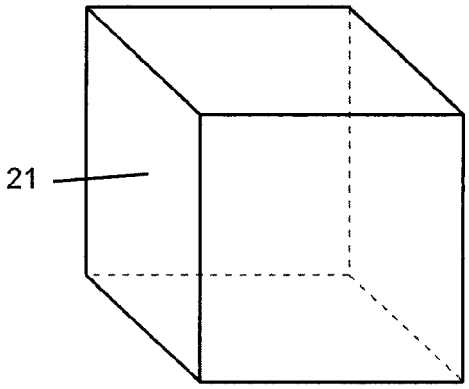
FIG. 16 shows a perspective view of the center piece (21).
Figure 17:
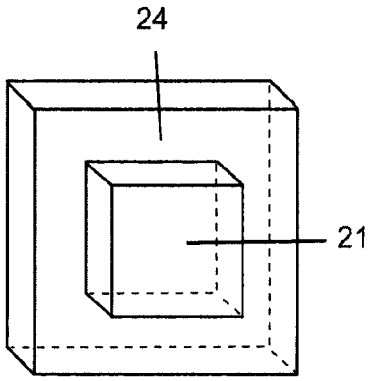
FIG. 17 shows a perspective view of an extension piece (24) and spacer piece (26).
Figure 18:
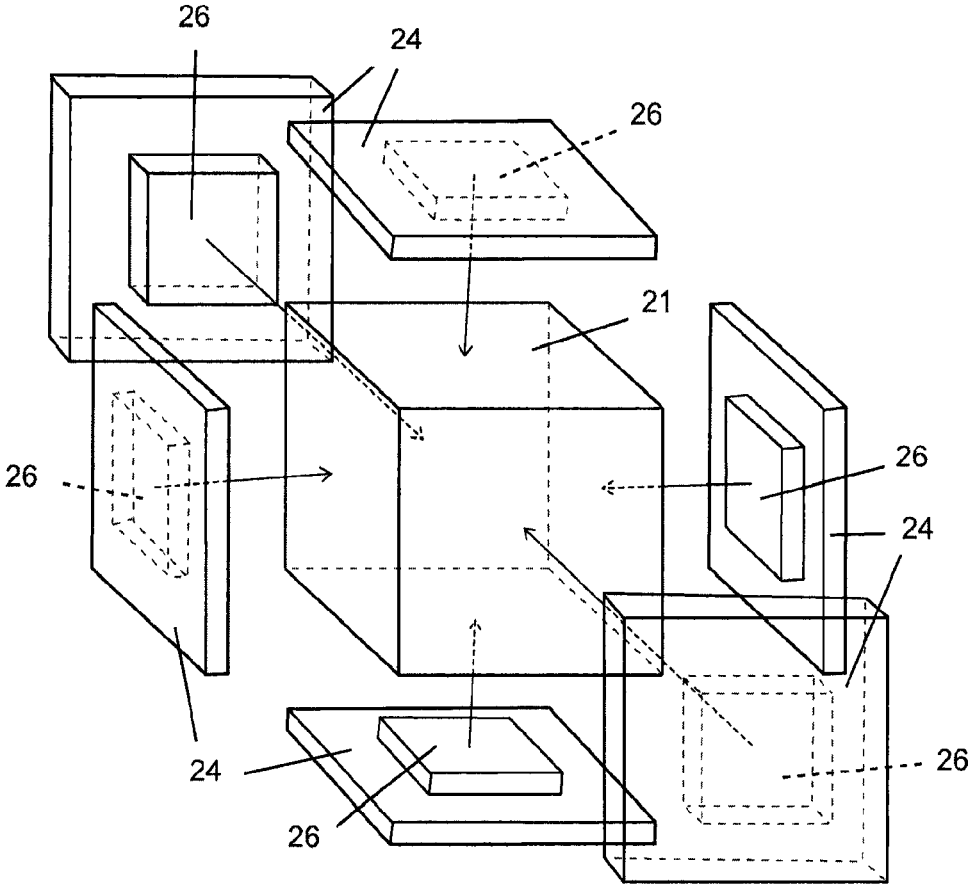
FIG. 18 shows an exploded view of the assembled block. As shown, the extension piece (24) is attached to the spacer piece (26) which is attached to the center piece (21), on all six sides.

In an other nonlimiting example of manufacturing, the toy blocks of the present invention can be made with a solid center piece (21) without protruding cylindrical rods (27) as follows: to assemble the Building Block Toy With Interconnecting Edges in wood, spacer piece (26) is centered onto extension piece (26) without protruding cylindrical rods (27) and glued into place. This procedure is repeated with five additional extension pieces (24) and five additional spacer pieces (26) for each Building Block. The assembled extension piece (24) and spacer piece (26), FIGS. 14 and 17, is then centered onto one side of the center piece (21) and glued into place. This procedure is then repeated with the five additional assembled extension pieces (24) and spacer pieces (26), FIGS. 14 and 17, onto the five remaining sides of center piece (21) as in FIGS. 15 and 18.

The following examples are provided to further illustrate the advantages and features of the present invention, but are not intended to limit the scope of the invention. While they are typical of those that might be used, other procedures, methodologies, or techniques known to those skilled in the art may alternatively be use.

Example 1

To produce the block toy of the present invention in plastic, molds will need to be made for the parts identified in the drawings as center piece with insertion holes (22) and extension piece with protrusions.

To assemble the Building Block Toy With Interconnecting Edges in plastic, the two protrusions (27) on the interior side of the face piece with protruding cylindrical rods (27), FIGS. 7, 8, 9, are aligned with the two insertion holes (22) on one side of the center piece (21) with holes. The two protruding cylindrical rods (27) are then inserted into the two insertion holes (22) until the parallel side of the spacer piece (26) of the extension piece (24) is in contact with the parallel side of the center piece (21) as in FIG. 10. The insertion holes (22) and the protruding cylindrical rods (27) are aligned so that the extension piece (24) and the center piece (21) will square up. Because the protruding cylindrical rods (27) are narrower at the point where the rods (27) are attached to the spacer piece (26) of the extension piece (24), and are slightly wider at the exterior end, the extension piece (24) will lock into place. This procedure is then repeated for the remaining five sides of the center piece (21) as in FIGS. 10 and 11.

Example 2

To produce the block toy of the present invention in wood, six extension face pieces without protrusions, six spacer pieces and one center piece without holes will have to be cut from wood.

To assemble the Building Block Toy With Interconnecting Edges in wood, spacer piece (26) is centered onto extension piece without protruding cylindrical rods (27) and glued into place. This procedure is repeated with five additional extension pieces (24) and five additional spacer pieces (26) for each Building Block. The assembled extension piece (24) and spacer piece (26), FIGS. 14 and 17, is then centered onto one side of the center piece (21) and glued into place. This procedure is then repeated with the five additional assembled extension pieces (24) and spacer pieces (26), FIGS. 14 and 17, onto the five remaining sides of center piece (21) as in FIGS. 15 and 18.

Example 3

Interconnectivity

The toy blocks of the present invention can interconnect. To interconnect the toy blocks, the extension piece of a first toy block slides between the extension piece and the center of a second block. Toy blocks can continue to interconnect with other blocks without limit. The toy blocks can interconnect in all three dimensions.

Example 4

Model

The toy blocks of the present invention can be used to build a model. For example the toy blocks can be manufactured in the necessary colors and come with instructions to build a model car.

Example 5

Game

The toy blocks of the present invention can be used to play a game. For example, players can take turns in interconnecting the toy blocks until the structure falls over. The player who caused the toy block tower to fall would lose the game.

Although the invention has been described with reference to the above example, it will be understood that modifications and variations are encompassed within the spirit and scope of the invention. Accordingly, the invention is limited only by the following claims.

What is claimed is:

1. A block comprising:

a) a center piece which is a cube having insertion holes on each face of the center piece, each face being defined by a square perimeter; and b) a plurality of pieces, each piece of the plurality being attached to each face of the center piece, wherein each piece of the plurality comprises:

(i) an extension piece having an inner face defined by a square perimeter and an outer face defined by a square perimeter, the faces being separated along a central axis thereby defining a rectangular prism having a width along the central axis, and (ii) a spacer piece having an inner face defined by a square perimeter and an outer face defined by a square perimeter separated along the central axis thereby defining a rectangular prism having a width along the central axis, wherein the outer face of the spacer piece is attached to the inner face of the extension piece, the spacer piece extending along its width from the inner face of the extension piece along the central axis, the square perimeter of the outer face of the spacer piece being half the size of the square perimeter of the inner face of the extension piece, wherein each of the plurality of pieces is attached to each face of the center piece via rods disposed on the inner surface of the spacer piece corresponding to the insertion holes of each face of the center piece;

wherein the width of each of the extension pieces is generally equal to the width of each of the spacer pieces, and wherein the square perimeter of the outer face of each extension piece is equal to the square perimeter of each face of the center piece.

2. The block of claim 1, wherein the center piece, extension piece and spacer piece are hollow.

3. The block of claim 1, wherein the center piece, extension piece and spacer piece are solid.

4. The block of claim 1, wherein the extension piece is attached squarely with the center piece.

5. The block of claim 1, wherein the center piece, extension piece, spacer piece and rods are made from material selected from the group consisting of: acrylic, wood, plastic, rubber, metal and bamboo.

6. The block of claim 1, wherein the protruding cylindrical rods are no longer than half the depth of the insertion holes.

7. The block of claim 6, wherein each rod is tapered.

8. At least two or more blocks of claim 1, wherein at least one block interconnects with another block wherein at least one extension piece of a first block is placed between the extension piece and center piece of a second block.

9. The one or more blocks of claim 8, wherein an infinite number of blocks are interconnected.

10. The use of at least two or more blocks of claim 8, wherein the blocks interconnect to form a model.

11. A game comprising one or more blocks of claim 1, a game board, game tokens, dice, spinner and cards.

* * * * *